US010639689B2

(12) United States Patent
Di Giacomo et al.

(10) Patent No.: US 10,639,689 B2
(45) Date of Patent: May 5, 2020

(54) GUIDE DEVICE FOR ROLLING LONG METAL PRODUCTS

(71) Applicant: DANIELI & C. OFFICINE MECCANICHE SPA, Buttrio (IT)

(72) Inventors: Marco Di Giacomo, Cormons (IT); Tiziano De Giorgio, Udine (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 269 days.

(21) Appl. No.: 15/111,884

(22) PCT Filed: Jan. 15, 2015

(86) PCT No.: PCT/IB2015/050308
§ 371 (c)(1),
(2) Date: Jul. 15, 2016

(87) PCT Pub. No.: WO2015/107477
PCT Pub. Date: Jun. 23, 2015

(65) Prior Publication Data

US 2016/0332204 A1 Nov. 17, 2016

(30) Foreign Application Priority Data

Jan. 16, 2014 (IT) ..... UD2014A000008

(51) Int. Cl.
*B21B 39/14* (2006.01)
*B21B 39/16* (2006.01)

(52) U.S. Cl.
CPC ..... *B21B 39/165* (2013.01); *B21B 39/14* (2013.01)

(58) Field of Classification Search
CPC ..... B21B 39/006; B21B 39/008; B21B 39/10; B21B 39/12; B21B 39/14; B21B 39/16;
(Continued)

(56) References Cited

U.S. PATENT DOCUMENTS 4,056,873 A * 11/1977 Cassard ..... B21B 39/165 492/3
4,109,972 A * 8/1978 Easter ..... B21B 39/165 384/455

(Continued)

FOREIGN PATENT DOCUMENTS

DE 1602071 4/1970
EP 0143523 6/1985

OTHER PUBLICATIONS

International Search Report and Written Opinion of PCT/IB2015/050308 dated Apr. 23, 2015, 7 pages.

*Primary Examiner* — Edward T Tolan
(74) *Attorney, Agent, or Firm* — Rankin, Hill & Clark LLP

(57) ABSTRACT

Guide device for rolling long metal products, comprising at least a pair of guide rolls coplanar with each other and rotatable round axes of rotation inclined with respect to a rolling axis, a support body on which the guide rolls are mounted and configured to keep the guide rolls constantly in contact with the long metal products, and a support structure configured to support the support body and to which the latter is attached. At least the support structure is made of one or more non-ferrous metal materials with a specific weight less than half the average weight of steel and with heat conductivity equal to or greater than double the average heat conductivity of steel.

10 Claims, 1 Drawing Sheet

(58) Field of Classification Search
CPC ..... B21B 39/165; B21D 3/05; B65H 27/00; B65H 51/10; B65H 2404/14211
See application file for complete search history.

(56) References Cited

U.S. PATENT DOCUMENTS 4,700,875 A * 10/1987 Fabris ..... B21B 39/165 226/176
4,777,822 A * 10/1988 Uemura ..... C04B 35/584 492/3
4,876,875 A * 10/1989 Bruggeman ..... B21B 27/035 492/3
5,491,881 A * 2/1996 Collins ..... A01K 87/04 29/417
5,556,499 A * 9/1996 Clough ..... B29C 63/0013 156/701
5,937,689 A * 8/1999 Fabris ..... B21B 39/165 226/177
6,151,946 A * 11/2000 Fabris ..... B21B 39/165 72/250
7,062,946 B2 * 6/2006 Palzer ..... B21B 39/165 72/250
8,298,357 B2 * 10/2012 Sano ..... B21C 23/002 148/690
2005/0189389 A1 * 9/2005 Rumer ..... B65H 23/02 226/21
2006/0283227 A1 * 12/2006 Monahan ..... B21B 39/165 72/251
2007/0170408 A1 * 7/2007 Martinez ..... H02G 1/06 254/338
2011/0259071 A1 * 10/2011 Iogna Prat ..... B21B 39/165 72/250
2012/0272705 A1 * 11/2012 Hirane ..... B21D 1/06 72/200

* cited by examiner

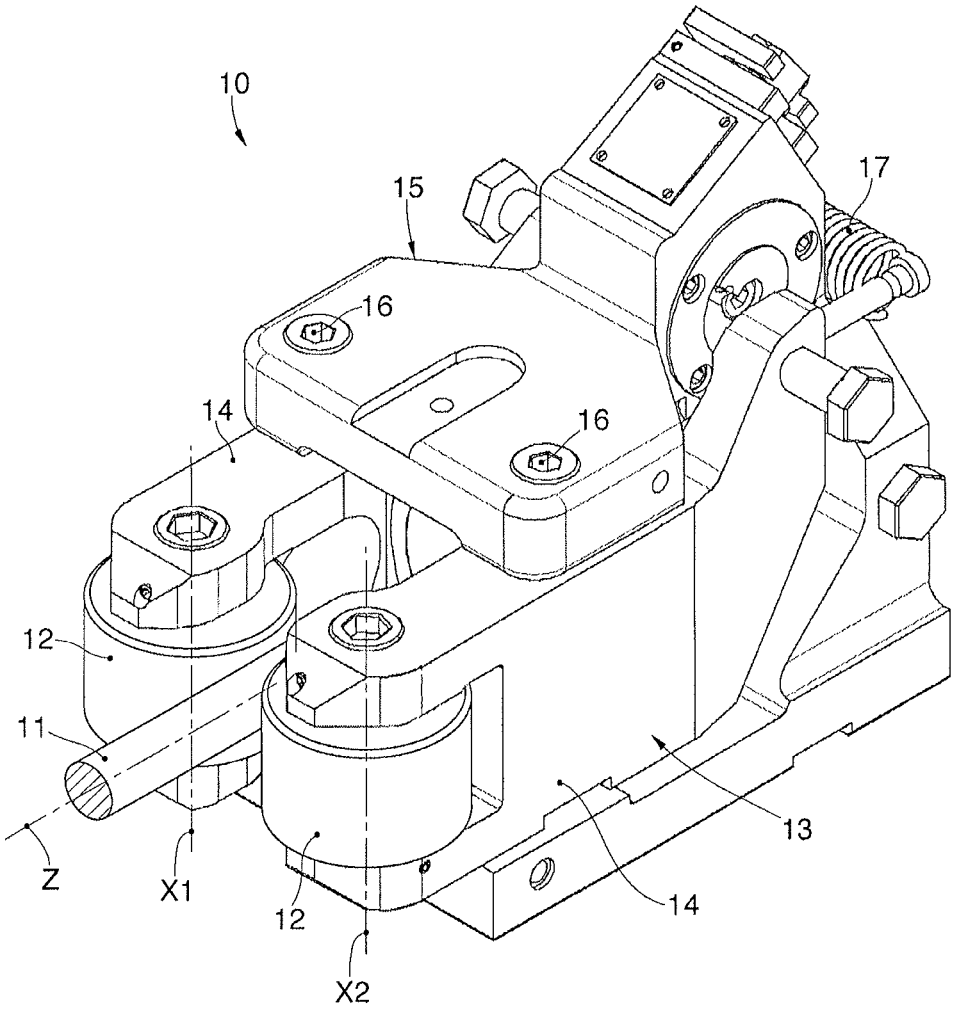
10
15
17
16
16
14
12
11
Z
X1
12
X2
13
14

GUIDE DEVICE FOR ROLLING LONG METAL PRODUCTS

FIELD OF THE INVENTION

The present invention concerns a guide device used in the field of rolling long metal products to guide and support said metal products on entering or exiting a rolling stand.

In particular, the present invention concerns a guide device configured to guide long, thin metal products such as bars, ribbed bars, rod or wire, by way of non-restrictive example, in terminal steps of the rolling process, for example in finishing and/or intermediate trains.

BACKGROUND OF THE INVENTION

The rolling of long, metal products such as thin bars, ribbed bars, rod, wire or other similar products is known, which provides the progressive reduction in thickness of said metal products by means of cylinders, rolls or rotating rings in rolling stands located one after the other along a rolling axis.

In the last steps of the rolling process it is known to use, for example, one or more guide devices, each configured to guide and support the metal products on entering into or exiting from a rolling stand, to a finishing stand for example.

Such guide devices, examples of which are shown in EP 0.143.523 and in DE 1.602.071, are needed to keep the metal products, in particular when the thickness is reduced to a value of a few millimeters, in the correct working position in line with the gap defined between the rolls or rings.

The known guide devices each normally comprise at least a pair of guide rolls mounted on a support body and with axes of rotation orthogonal to the rolling axis.

The guide rolls are usually idle and kept constantly in contact with the products being rolled, from which they receive, by friction, the rotatory motion. The external surface in contact with the products being rolled can be flat or grooved.

Guide rolls are known made of one material, in a single piece, or made of two or more materials, in which a ring of a first material, hard and resistant to wear, is integrated with a core or hub made of a second material, normally less hard and lighter than the first material.

It is also known that each guide device includes a support structure to which the support body of the guide rolls is attached.

The function of the support structure is to support the support body and allow the stable attachment of the guide device in a desired position upstream or downstream of the corresponding rolling stand and in close proximity to the corresponding rolls or rings.

The products being rolled generally transit inside the guide device at high speeds, even up to about 150 m/s, and have temperatures that can be comprised between 800° C. and 1,100° C. for example.

As a consequence of the conditions reported above, it is necessary to make the guide rolls of such guide devices, at least in the part which is in contact with the metal products in transit, of materials that are hard and resistant to wear, for example ceramic materials with a carbide base.

It is also necessary to make the support body so that it is able to resist, for the entire duration of the rolling process, the high temperatures quoted above, without suffering macro- or micro-structural modifications. For this reason, the support body is normally made of steel, preferably stainless steel.

Moreover, it is necessary to make the support structure robust and resistant to mechanical stresses that originate during high-speed rolling and, at the same time, resistant to impacts or other stresses that occur in normal functioning, and also unforeseen ones. For this reason, the support structure is normally made of steel.

It is known that the guide devices are removed from their assembled position on the rolling line every time it is necessary to carry out maintenance, or to remove the scale that has been deposited during rolling, or to replace them after changing section or type of long metal product to be rolled.

One disadvantage of known guide devices is that they are heavy and require the assistance of mechanical lifting and moving arms for their removal, thus determining extended procedure times. This disadvantage can consequently lead to extended down-times for maintenance, with negative effects also on the overall production costs and overall productivity.

Moreover, heavy guide devices can be a source of risk for the operators since, if moved manually, they can cause accidents and/or occupational injuries, for example damage to the back or lumbar muscles of the operators.

Another disadvantage of known guide devices is that they have a heat conductivity such that the discharge of the heat accumulated during rolling, in particular in the parts nearest the product in transit, occurs with relatively long times, even up to a few dozen minutes after the end of rolling. This considerably delays the possibility of intervention of an operator with respect to the stopping of the plant, with consequent lengthening of intervention and maintenance times, and has a negative effect on the overall costs of the production process.

Moreover, an excessive accumulation of heat due to a relatively limited heat conductivity can have negative effects on the mechanical resistance of the material, if this is subjected to high temperatures for an excessively long time.

Furthermore, another disadvantage of known guide devices is that they are complex to make and they require long and costly operations to be produced, in particular because of the resistance and physical characteristics of steel.

In the field of rolling long products, these problems have never been looked at in their entirety, to find a solution that could provide the compromise for the different needs. It must also be taken into account that the problems connected to the high temperatures are verified in the increasingly high speeds at which the metal product is rolled, with the evolution of technology, even recent. Moreover, the problems linked to the weight of the guides, and thus linked to the risk of accidents and occupational injuries, are reflected in the evolution of legislation on safety in the workplace.

This explains the mental block of those working in this field against considering possible alternatives to steel in making this type of guide, since the above problems are not considered, and since until now steel has always been considered a material that can satisfy all the requirements of the normal functioning of this type of equipment.

Contrary to the operating tradition, now consolidated in this sector, and trying to find a solution to the new problems posed by the evolution of rolling technology both in terms of process and in terms of equipment, Applicant set himself the task of finding an alternative solution to using the standard, consolidated materials used in this sector, to overcome the disadvantages that have been created due to technological evolution and developments.

One purpose of the present invention is therefore to make a guide device for long metal products, associable to rolling stands of the type with cylinders, rolls or rings, which can be removed quickly and easily for maintenance or replacement, and which therefore allows to reduce the down-times, speeding up the production process in its entirety.

Another purpose of the present invention is to make a guide device that is light, easy to move, even manually by an operator without needing to use lifting and moving means. A light guide device can also allow to reduce the physical efforts that an operator must perform in order to move it manually, which all means a reduction in the risk of accidents and occupational injuries, for example to the back or lumbar muscles of the operator. This advantageously allows to reduce the absences of the operator from work because of accidents or injuries, as well as to satisfy any possible legislation on safety at work currently in force.

It is also a purpose of the present invention to make a guide device that is resistant mechanically and able to discharge rapidly the heat accumulated during the rolling process, making the intervention times quicker at the end of a corresponding rolling pass.

Another purpose of the present invention is to make a guide device that, to be produced, needs less time and less complex and costly mechanical workings than those used in the state of the art.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a guide device for rolling long metal products according to the present invention is installable in a rolling plant, along a rolling axis, upstream and/or downstream with respect to a rolling stand and is configured to guide the long metal products on entrance to or exit from the rolling stand.

The guide device comprises at least a pair of guide rolls coplanar with respect to each other, with axes of rotation inclined, for example orthogonal, with respect to the rolling axis, and mounted on a support body configured to maintain the guide rolls constantly in contact with the long metal products.

The guide device also comprises a support structure that defines to a large extent the overall external bulk of the guide device, configured to support the support body and to which the support body itself is attached.

The support structure also has the function of allowing the assembly of the entire guide device to the bearing components of the rolling line and makes up the part, that, during use, is furthest from the path of the metal product in transit.

According to a characteristic feature of the present invention, at least the support structure is made of one or more non-ferrous metal materials with a specific weight less than half the average weight of steel, preferably equal to or less than 3 g/cm$^3$, and having heat conductivity equal to or more than double the average of steel, preferably higher than 140 W/mK.

In this way a guide device is advantageously obtained for rolling long metal products which is lighter, by 30% and even up to 40% overall, than known guide devices made of stainless steel.

This lighter guide device has the advantageous consequence, neither foreseen nor foreseeable for the person of skill who does not set himself the problem, that it can be moved manually, and is light enough to be removed and maneuvered by an operator without the assistance of mechanical lifting and moving means.

This contributes to speeding up the removal operations of the guide devices, considerably reducing the down-times of the plant needed to carry out such operations, as well as reducing the fatigue of the operators and the connected risks of accidents, as well as allowing to respect any safety norms in force.

Moreover, a support body made according to the present invention has the advantage that it transmits heat much more than steel, cooling more rapidly, taking only a few minutes for this process, compared to the dozens of minutes needed to cool known devices.

The rapid cooling process has a positive and advantageous effect on the intervention times of the operator, and also on the risks connected to burns or abrasions, allowing to reduce both the down-times of the plant, with consequent increase in productivity and the utilization factor of the rolling plant, and also the overall rolling costs. From this point of view too, this solution allows to respect much more easily any safety norms in force.

According to some aspects of the present invention, the one or more non-ferrous metal materials with which at least the support structure is made are chosen from a group comprising light metal alloys with an aluminum or magnesium base and containing at least two elements of either aluminum, magnesium, titanium, copper, zinc, silicon.

In some forms of embodiment, the one or more metal materials cited above have a mechanical resistance to traction higher than at least 300 MPa.

In some forms of embodiment of the guide device, both the support body and the support structure are made of the same non-ferrous metal material chosen from the above group.

According to a variant of the present invention, at least the support structure is made of an aluminum-magnesium-silicon alloy 6082, or an aluminum-zinc alloy 7075.

In other forms of embodiment, the support structure is made of a first non-ferrous metal material and the support body is made of a second non-ferrous metal material, and it is provided that the first metal material has a mechanical resistance higher than that of the second metal material and that the second metal material has a heat conductivity higher than that of the first metal material.

In some forms of embodiment, the first metal material is an aluminum-zinc 7075 alloy, and the second metal material is an aluminum-magnesium-silicon 6082 alloy.

BRIEF DESCRIPTION OF THE DRAWINGS

These and other characteristics of the present invention will become apparent from the following description of a form of embodiment, given as a non-restrictive example with reference to the attached FIG. 1, which shows a three-dimensional view of a guide device for rolling long metal products made according to the present invention.

DETAILED DESCRIPTION OF SOME FORMS OF EMBODIMENT

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

The attached FIG. 1 is used to describe forms of embodiment of a guide device 10 usable in rolling long metal products, such as for example thin bars, ribbed bars, rod, wire or other similar products.

In the present description, for clarity and simplicity of exposition, we shall refer by way of example to a bar 11 which is rolled in rolling stands, not shown in the drawings, along a rolling axis Z.

With reference to FIG. 1, in possible forms of embodiment, the guide device 10 includes a pair of guide rolls 12, coplanar with respect to each other and mounted idle on respective axes of rotation X1, X2.

The axes of rotation X1, X2 of the guide rolls 12 are parallel to each other and are positioned on opposite sides of the rolling axis Z, with respect to which they are inclined, orthogonal for example.

In some forms of embodiment, the guide device 10 can also include two or more support levers 14, on each of which one of the guide rolls 12 is mounted.

The support levers 14 in their entirety define a support body 13 configured to support the guide rolls 12.

It is understood that such forms of embodiment are described hereafter merely by way of example of possible solutions of the support body 13 and are not intended to limit the latter to the specific configuration. Indeed, it is not excluded that the support body 13 can be made according to other configurations, while keeping the same function of supporting the guide rolls 12. For example, it can be provided that the support body 13 is made in a single piece, conformed as a fork and suitably shaped, and that it includes, instead of the support levers 14, two arms on which the guide rolls 12 are mounted.

The support body 13 can be configured to keep the guide rolls 12 constantly in contact with the bar 11 during rolling.

For example, the positioning of the support levers 14 can be chosen so that the interaxis of the guide rolls 12 is such as to distance the external surface of the guide rolls 12 by an amount equal to or a little less than the transverse size of the bar 11.

In this way, the guide rolls 12 are both constantly in contact with the bar 11 that passes between them, but without exerting any further rolling on the bar 11 itself. The passage of the bar 11 between the guide rolls 12 confers on them, by friction on their external surface, the rotatory motion around the respective axes of rotation X1 and X2.

The passage of the bar 11 through the guide rolls 12 generally occurs, using recently developed process and equipment technologies, at high speeds, in the order of 100 m/s, even up to 150 m/s, and with temperatures normally between about 800° C. and 1,100° C.

In some forms of embodiment, to resist the high stresses to which it is subjected, each guide roll 12 can be made, at least in its external part, of a ceramic material, for example containing carbides, nitrides, carbonitrides, or hard oxides.

In possible solutions, the external part can be defined by a ring integrated with a central core, made of a tougher material, for example steel or an aluminum alloy.

The guide device 10 can also include a support structure 15, to which the support body 13 is attached, configured to support the support body 13 and defining to a large extent the overall external bulk of the guide device.

The support structure 15 also has the function of allowing the assembly of the guide device 10 to the bearing components of the rolling line in the desired position along the rolling axis Z.

In some forms of embodiment, the support body 13 can be made of steel, stainless steel for example.

The support structure 15 is made of one or more non-ferrous metal materials with a specific weight lower than half the average weight of steel, preferably equal to or less than 3 g/cm$^3$, and with heat conductivity equal to or higher than double the average of steel, preferably higher than 140 W/mK.

Among the non-ferrous metal materials used to make the support structure 15 light metal alloys can be included for example, with an aluminum or magnesium base and containing at least two elements of either aluminum, magnesium, titanium, copper, zinc or silicon.

Possible solutions provide to use an aluminum alloy from the 6000 series, that is, belonging to the aluminum-magnesium-silicon alloys, denominated 6082, also known by the trade name "Anticorodal 100".

This alloy has a specific weight of about 2.7 g/cm$^3$, that is, about a third of the average weight of stainless steels, a heat conductivity of about 165 W/mK, that is, from about 6 to about 15 times higher than the average of stainless steels, and a typical resistance to traction of about 300 MPa.

Alternative solutions can provide that the support structure 15 is made of an aluminum alloy of the 7000 series, that is, belonging to the aluminum-zinc alloys, denominated 7075, also known by the trade name "Ergal 55".

This alloy has a specific weight of about 2.8 g/cm$^3$, that is, about a third of the average weight of stainless steels, a heat conductivity of about 155 W/mK, that is, from about 5 to about 10 times higher than the average of stainless steels, and a typical resistance to traction of about 500 MPa.

In some forms of embodiment, the support structure 15 is made using both the above-mentioned aluminum alloys.

In variant solutions, it can be provided that the support body 13 is made with one or both the aluminum alloys 6082 and 7075.

When it is not made of steel, the support body 13 can be made of the same non-ferrous material as the support structure 15.

It can also be provided that the support structure 15 is made of a first non-ferrous material, for example aluminum alloy 7075, and the support body 13 made of a second non-ferrous material, for example aluminum alloy 6082, or vice versa.

It is clear from the above that, using a light non-ferrous alloy, for example with an aluminum base, the weight of the support structure 15, and possibly the support body 13, can advantageously be limited. The reduction in weight of these components of the guide device 10, which can even reach two thirds of the weight that, given the same sizes, they would have if they were made of steel, allows an overall reduction in weight of the guide device 10 of more than 30%, even up to 40% and more.

This allows to keep the overall weight of the guide device 10, in preferential solutions, below 20 kg, which, according to some norms, constitutes a maximum weight limit that is allowed to be maneuvered manually by an operator without the assistance of mechanical lifting and movement means or arms, such as hoists, cranes, gantries or other similar machinery.

The heat conductivity of the non-ferrous material cited above, in particular of the aluminum alloys, is such that the cooling of the support structure 15, and possibly also the support body 13, occurs at a considerably higher speed than that which said components would have if they were made of steel.

As a consequence, this allows a considerably quicker cooling of the device guide 10, and therefore allows an operator to intervene, if necessary, on the guide device 10 itself, for example to replace it, or to disassemble it for maintenance, to intervene more rapidly and just before the suspension of rolling.

Moreover, the use of the aluminum alloys cited above instead of stainless steel allows to reduce production costs and times of the support structure 15, and possibly also the support body 13, since these alloys allow to adopt less complex and less costly workings with respect to those needed for stainless steel.

In some forms of embodiment, described by way of example with reference to the attached drawing, the support body 13 can be attached to the support structure 15 by means of pivoting elements 16 around which each of the support levers 14 is configured to rotate.

This rotation can be intended to allow the movement of the guide rolls 12 reciprocally further away or nearer, in order to compensate possible irregularities or discontinuities in the size of the bar 11.

FIG. 1 is used to describe forms of embodiment of the guide device 10 in which an elastic return member, for example a pre-compressed spring 17, is provided to allow the rotation of the support levers 14 and, at the same time, to make them stretch toward a pre-set inactive position in which the guide rolls 12 are at a desired reciprocal distance.

It is clear that modifications and/or additions of parts may be made to the guide device 10 for rolling long metal products as described heretofore, without departing from the field and scope of the present invention.

For example, in possible forms of embodiment, the guide device 10 can include one or more pairs of guide rolls 12, mounted on two or more corresponding support bodies 13 attached to the support structure 15 one after the other along the rolling axis Z.

It is also clear that, although the present invention has been described with reference to some specific examples, a person of skill in the art shall certainly be able to achieve many other equivalent forms of guide device, having the characteristics as set forth in the claims and hence all coming within the field of protection defined thereby.

The invention claimed is:

1. Guide device for rolling long metal products, comprising at least a pair of guide rolls coplanar with each other and rotatable round axes of rotation inclined with respect to a rolling axis, a support body on which said guide rolls are mounted and configured to keep said guide rolls constantly in contact with said long metal products, said guide rolls are rotatable independent of said support body, and a support structure configured to support said support body and to which the latter is attached, wherein the support structure and the support body are made of one or more non-ferrous metal materials with a specific weight less than half the average weight of steel and with heat conductivity equal to or greater than double the average heat conductivity of steel, wherein the support body includes a pair of rotatable support levers, one support lever for each guide roll, and wherein an elastic return member is mounted to the support body, connected to each rotatable support lever of the pair of rotatable support levers, and directed substantially perpendicular to the pair of rotatable support levers to allow for rotation of the pair of rotatable support levers, such that the pair of rotatable support levers stretch toward a pre-set inactive position of the guide rolls.

2. Guide device as in claim 1, wherein said one or more non-ferrous metal materials have a specific weight equal to or less than 3 g/cm$^3$.

3. Guide device as in claim 1, wherein said one or more non-ferrous metal materials have a heat conductivity higher than 140 W/m K.

4. Guide device as in claim 1, wherein said one or more metal materials of which at least the support structure is made are chosen from a group comprising light metal alloys with an aluminum or magnesium base and containing at least two elements of either aluminum, magnesium, titanium, copper, zinc or silicon.

5. Guide device as in claim 1, wherein said one or more metal materials have a mechanical resistance to traction higher than at least 300 MPa.

6. Guide device as in claim 1 wherein the support structure and the support body are both made of the same non-ferrous metal material.

7. Guide device as in claim 1, wherein the support structure is made of a first non-ferrous metal material, and the support body is made of a second non-ferrous metal material, said first non-ferrous metal material having a mechanical resistance higher than that of the second non-ferrous metal material, and said second non-ferrous metal material having a heat conductivity higher than that of the first non-ferrous metal material.

8. Guide device as in claim 1 any claim hereinbefore, wherein said support structure is made of an aluminum-magnesium-silicon alloy 6082 and/or an aluminum-zinc alloy 7075.

9. Guide device as in claim 1, wherein the support body is made of an aluminum-magnesium-silicon alloy 6082 and/or an aluminum-zinc alloy 7075.

10. Guide device as in claim 1, wherein the support body is attached to the support structure by pivoting elements round which each of the support levers is configured to rotate.

* * * * *